US005286922A

United States Patent [19]

Curtiss

[11] Patent Number: 5,286,922

[45] Date of Patent: Feb. 15, 1994

[54] FLUORESCENT COATED WIRE

[76] Inventor: Thomas E. Curtiss, 8512 S. Fordyce Rd., Mt. Pleasant, Mich. 48858

[21] Appl. No.: 913,037

[22] Filed: Jul. 14, 1992

[51] Int. Cl.[5] ..... H01B 7/36

[52] U.S. Cl. ..... 174/112; 250/458.1; 256/10; 428/117

[58] Field of Search ..... 174/112; 40/542, 543; 250/458.1; 256/10; 427/117

[56] References Cited

U.S. PATENT DOCUMENTS

| | | | |
|---|---|---|---|
| 2,382,355 | 8/1945 | Warren, Jr. | 174/112 |
| 2,410,277 | 10/1946 | Farris | 174/112 |
| 2,588,183 | 3/1952 | Vigon | 40/542 |
| 2,658,295 | 11/1953 | Young et al. | 40/542 |
| 2,761,069 | 8/1956 | Brayer | 174/112 |
| 2,939,271 | 6/1960 | Nadel | 174/112 |
| 3,978,599 | 9/1976 | Berger | 40/542 |
| 4,819,914 | 4/1989 | Moore | 178/128.1 |
| 4,895,740 | 1/1990 | Hiromori et al. | 427/358 |
| 4,959,266 | 9/1990 | Ueno et al. | 174/113 R |
| 4,973,029 | 11/1990 | Robbins, III | 174/120 SC |
| 5,036,166 | 7/1991 | Monopoli | 256/10 |

FOREIGN PATENT DOCUMENTS

| | | | |
|---|---|---|---|
| 261984 | 8/1963 | Australia | 174/112 |
| 2214427 | 10/1973 | Fed. Rep. of Germany | 174/112 |
| 2555908 | 6/1977 | Fed. Rep. of Germany | 174/112 |
| 3003678 | 8/1981 | Fed. Rep. of Germany | 174/112 |

*Primary Examiner*—Morris H. Nimmo
*Attorney, Agent, or Firm*—Richard C. Litman

[57] ABSTRACT

An electrical conducting wire for providing high visibility. The conducting wire is coated with a conducting, colored paint which improves the wires visibility. The conducting wire can be used in electric fencing of livestock or high-tension power lines commonly seen around airports.

9 Claims, 2 Drawing Sheets

FLUORESCENT COATED WIRE

FIELD OF THE INVENTION

The present invention relates to electrical conducting wires and, in particular, to a color coated electrical wire.

BACKGROUND OF THE INVENTION

Coating electrical wires has gained wide acceptance as a way of insulating and protecting electrical wires. For example, U.S. Pat. No. 4,959,266 issued Sep. 25, 1990 to Keiji Ueno provides a urethane-resin jacket system for electrical wires which can be formed by extrusion coating without causing deformation of previous coatings on the conducting wires. In addition to insulation coatings, conducting wires have been covered with visibility enhancement means for increased visibility to both humans and livestock, especially at dusk or dawn when thin electrical wires are difficult to see.

U.S. Pat. No. 4,973,029 issued Nov. 29, 1990 to Edward S. Robbins III shows an electrically conductive wire for use in an electric fence where the wire has three layers: a core comprised of a metal conductor, an intermediate sheath of plastic imbued with carbon to make it conductive, and an outer sheath of plastic thin enough to permit a current to pass therethrough. The outer sheath is preferably white to enhance the visibility of the fence.

U.S. Pat No. 4,819,914 issued on Apr. 11, 1989 to Richard A. Moore shows an electrical fence for livestock having an inner conductive core of braided cable and an outer layer also braided, of synthetic fiber having contrasting colors to provide increased visibility. The outer braiding can be made with gaps such that when livestock contact the fence will receive a shock.

U.S. Pat. No. 4,895,740 issued on Jan. 23, 1990 to Masahiro Hiromori and Toshimi Nakahara shows a process for manufacturing colored, stainless steel wires for springs. The wire is coated with an enamel and baked before it is drawn out to the desired diameter.

U.S. Pat. No. 4,383,644 issued May 17, 1983 to Albertus C. Spanjersberg et al discloses a process and apparatus for the electrostatic spraying of electrically conductive paint onto a surface such as a motor car body, as an aid for propelling paint to the surface.

None of the above inventions and patents, taken either singly or in combination is seen to describe the instant invention as claimed.

SUMMARY OF THE INVENTION

Accordingly it is a principal object of the invention to provide an electrical wire with a visibility enhancement coating permitting good visibility in the low light conditions that prevail during dusk and dawn, to alert humans and animals of a wire carrying a current.

It is another object of the invention to provide an electrical wire with a coating, both of which conduct an electrical current.

It is further object of the invention to provide a coating that can be easily applied to am existing wire with little effort.

Still another object of the invention to provide a coating that can be easily applied with a brush or a compressed gas spray or by simply dipping an article into the coating.

It is an object of the invention to provide a fluorescent coating for enhancing the visibility of an electric wire which can be applied to an electric wire while it is conducting a current.

It is an object of the invention to provide a coating for the purpose described which is inexpensive, dependable and fully effective in accomplishing its intended purpose.

These and other objects of the present invention will become readily apparent upon further review of the following specification and drawings wherein like reference numerals designate corresponding parts of the several views.

DETAILED DESCRIPTION OF THE PREFERRED EMBODIMENT

Figure 2:
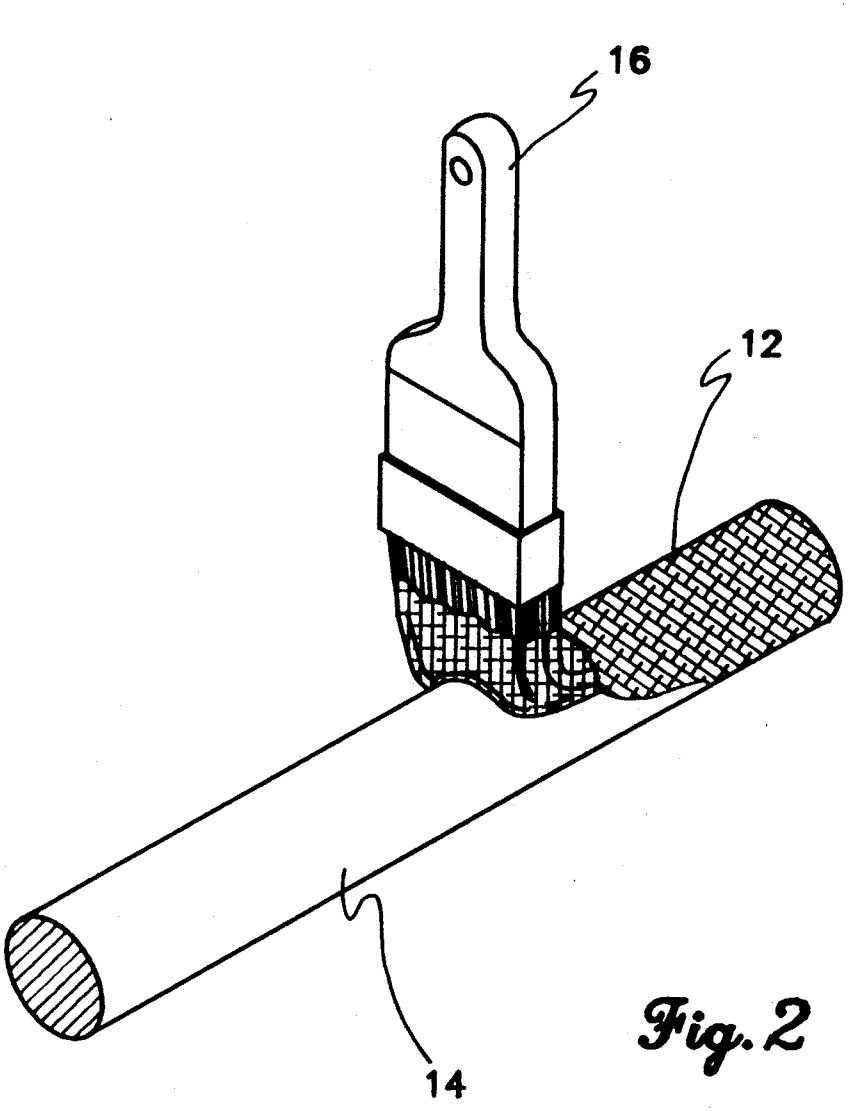
FIG. 2 is a perspective view of a single strand of wire being coated with electrically conductive fluorescent paint by a brush.
Figure 1:
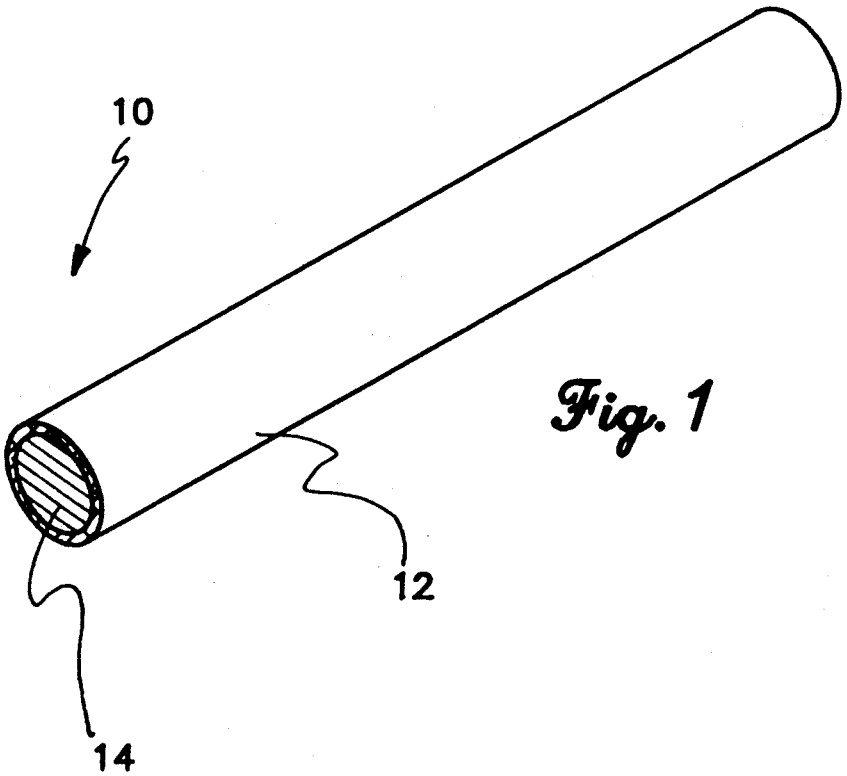
FIG. 1 is a perspective view of a single strand of wire coated with electrically conductive fluorescent paint.
Figure 3:
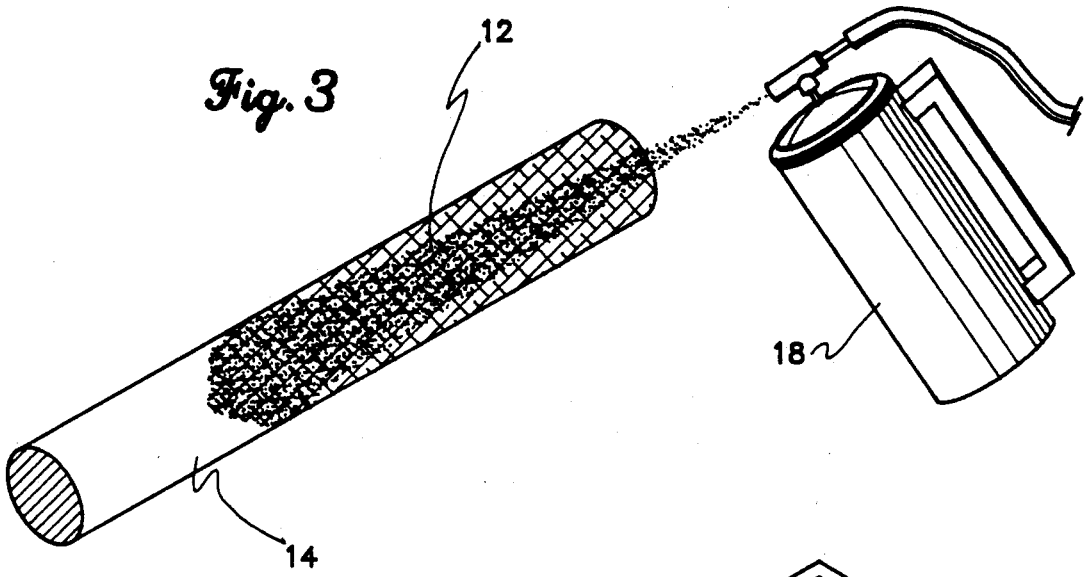
FIG. 3 is a perspective view of a single strand of wire being coated with electrically conductive fluorescent paint by a paint spray gun.
Figure 4:
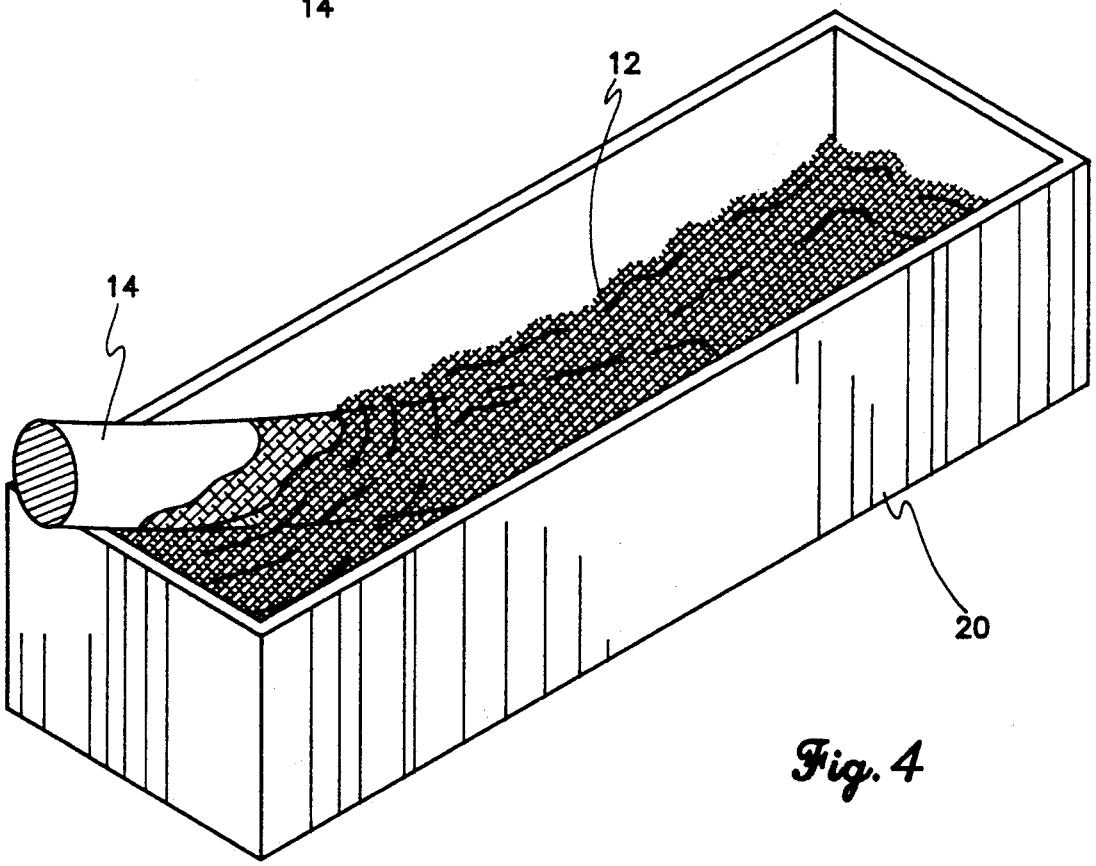
FIG. 4 is a perspective view of a single strand of wire being coated with electrically conductive fluorescent paint by dipping the wire into a paint container.

The electrical wire 10 of the present invention has an outer coating layer of a fluorescent paint 12 applied over a conductive material. The conductive material is a single strand of wire 14 made from a conductive material, such as stainless steel or carbon steel wire.

The outer coating layer is a fluorescent paint 12 capable of carrying a flow of electric charge. For fluorescing, the paint 12 has a material reacting to the ambient ultra violet present in daylight. The paint can be easily applied to a live wire 14, one which is already carrying a current, with little effort. The coating can be applied with a brush 16 or a compressed gas spray 18 or by simply dipping the wire 14 into the coating held in by a container 20. For a strong adhering between the fluorescent paint 12 and the conductive material, the surface of the conductive material should initially be cleansed of dirt and oily substances.

The colored electrically conductive wires 10 of the type described above may be incorporated into a fencing system including a plurality of vertically spaced wires, such as the type used in electrical fencing for livestock thus providing an electrical conducting wire of high visibility. Likewise, the electrical wires 12 could be wound into high tension electrical wires commonly seen around airports where visibility is a serious factor.

While in the preferred embodiment the conductive material is a single strand of wire 14, the paint 12 could readily be applied over a stranded core of two or ore conductors. And the paint may also be applied over conductors insulated with a resin coating material as is conventional.

It is to be understood that the present invention is not limited to the sole embodiment described above, but encompasses any and all embodiments within the scope of the following claims.

I claim:

1. An electrical wire having improved visibility, comprising:

an electrical conductor material, and a coating layer covering said conductor material, said coating layer being a colored, electrically conductive paint which includes a substance which fluoresces under daylight, whereby said coating layer is capable of carrying an electric charge and improving the visibility of the wire.

2. The invention as claimed in claim 1, wherein said conductor material is a stainless steel wire.

3. The invention as claimed in claim 1, wherein said conductor material is a carbon steel wire.

4. A method for making a fluorescent coated wire, comprising:

providing an electrical conductive wire, providing a colored, electrically conductive fluorescent paint which is capable of adhering to the conductive wire, and coating the conductive wire with the colored, electrically conductive fluorescent paint, whereby said paint is capable of carrying an electric charge and improving the visibility of the wire.

5. The method according to claim 4, wherein said coating step involves applying the fluorescent paint with a brush.

6. The method according to claim 4, wherein said coating step involves applying the fluorescent paint with compressed gas spray.

7. The method according to claim 4, wherein said coating step involves dipping said conductive wire into a container of said fluorescent paint.

8. The method according to claim 5, wherein said coating step is done while the wire is carrying a live current.

9. A method for improving visibility of electrical conductive wires comprising:

coating electrical conductive wires with a colored, electrically conductive fluorescent paint which is capable of carrying an electrical charge, wherein said paint improves the visibility of said electrical conductive wires.

* * * * *